US010052746B2

(12) United States Patent
Autschbach et al.

(10) Patent No.: US 10,052,746 B2
(45) Date of Patent: Aug. 21, 2018

(54) PRESSURE MONITORING DEVICE

(71) Applicant: Construction Tools GmbH, Essen (DE)

(72) Inventors: Uwe Autschbach, Oberhausen (DE); Stefan Lohmann, Mülheim (DE)

(73) Assignee: Construction Tools GmbH, Essen (DE)

( * ) Notice: Subject to any disclaimer, the term of this patent is extended or adjusted under 35 U.S.C. 154(b) by 519 days.

(21) Appl. No.: 14/748,851

(22) Filed: Jun. 24, 2015

(65) Prior Publication Data

US 2015/0375383 A1 Dec. 31, 2015

(30) Foreign Application Priority Data

Jun. 25, 2014 (DE) ..... 10 2014 108 849

(51) Int. Cl.
*B25D 9/14* (2006.01)
*B25D 9/12* (2006.01)

(52) U.S. Cl.
CPC ..... *B25D 9/145* (2013.01); *B25D 9/12* (2013.01)

(58) Field of Classification Search
CPC ..... B25D 9/145; B25D 9/26; E02F 9/226
See application file for complete search history.

(56) References Cited

U.S. PATENT DOCUMENTS 4,380,901 A * 4/1983 Rautimo ..... B25D 9/12 60/418
5,890,548 A * 4/1999 Juvonen ..... B25D 9/26 173/128
8,167,055 B2 * 5/2012 Piras ..... B25D 9/12 173/138

FOREIGN PATENT DOCUMENTS

DE 25 12 731 A1 10/1976
EP 0 752 297 B1 11/2000
JP 2008114296 A 5/2008

* cited by examiner

*Primary Examiner* — Andrew M Tecco
(74) *Attorney, Agent, or Firm* — McGlew and Tuttle, P.C.

(57) ABSTRACT

A device for monitoring the pressure within a gas space, which is filled with a gas, preferably nitrogen, and/or is prestressed, of a pressure accumulator of a hydraulically driven percussive mechanism, in particular of a demolition hammer or of a drilling hammer, having a housing in which a piston is mounted, together with an indicator element which extends through the face surface of the housing, in slidingly movable fashion. The piston divides the housing into two chambers, and a first, pressure accumulator-side chamber and a pressure accumulator-side working surface, which is averted from the indicator element, of the piston are operatively connected at least indirectly to the gas space of the pressure accumulator. A second, hydraulics-side chamber and a hydraulics-side working surface, facing toward the indicator element, of the piston are connected to the hydraulic system of the percussive mechanism.

22 Claims, 3 Drawing Sheets

PRESSURE MONITORING DEVICE

CROSS REFERENCE TO RELATED APPLICATIONS

This application claims the benefit of priority under 35 U.S.C. § 119 of German patent application DE 10 2014 108 849.2 filed Jun. 25, 2014, the entire contents of which are incorporated herein by reference.

FIELD OF THE INVENTION

The present invention relates to a device for monitoring the pressure within a gas space, which is filled with a gas, preferably nitrogen, and/or is prestressed, of a pressure accumulator of a hydraulically driven percussive mechanism, in particular of a demolition hammer or of a drilling hammer, having a housing in which a piston is mounted, together with an indicator element which extends through the face surface of the housing, in slidingly movable fashion, wherein the piston divides the housing into two chambers, and a first, pressure accumulator-side chamber and a pressure accumulator-side working surface, which is averted from the indicator element, of the piston are operatively connected at least indirectly to the gas space of the pressure accumulator.

BACKGROUND OF THE INVENTION

Hydraulically operated percussive mechanisms are used in mounted implements, such as for example hydraulic hammers or drilling hammers, wherein the mounted implements are mounted on carrier vehicles, in particular mobile excavators, and are connected to the hydraulic system thereof via a pressure line and a return line. Percussive mechanisms have a percussive piston which has one or more hydraulic drive surfaces, at least one of which is, by way of a valve, connected alternately to a return line, which is at low pressure, to the tank of the carrier vehicle or via a pressure line, which is at high pressure, to the pump of the mounted implement, such that the percussive piston performs an oscillating movement along its longitudinal axis. During normal operation, at the end of its movement in one movement direction, the percussive piston strikes a tool, wherein the tool is a chisel, a drill pipe, an adapter for piledriving or pipe driving, or an anvil arranged between the percussive piston and the tool.

Hydraulically operated percussive mechanisms have, in some cases, a pressure accumulator in the form of a piston accumulator in order to store kinetic energy of the percussive piston. The upper, cylindrical end, situated opposite the tool, of the percussive piston projects into a gas-filled gas space of the pressure accumulator, wherein a seal which bears against the end of the piston prevents an escape of the gas along the percussive piston.

As the piston moves in the direction of the gas space during the return stroke, the end of the piston displaces gas within the gas space, which thus decreases in size, leading to an increase in the gas pressure. The compressed gas exerts a force on the end of the piston, said force increasing as the gas volume decreases in size. Said force is utilized to accelerate the piston in the direction of movement toward the tool.

During operation, there are thus three characteristic piston positions which can be associated with a respective gas pressure. For example, if a hydraulic hammer which has a percussive mechanism is raised or set down horizontally, its percussive piston is situated in the lower rest position, in which the gas pressure in the piston accumulator assumes its lowest value. When the processing of a piece of material using a hydraulic hammer is ended and the operation of the percussive mechanism is stopped, in order to position the hydraulic hammer differently, the percussive piston assumes its rest position. If the chisel is pressed with its tip against material, the chisel is pushed into the housing of the percussive mechanism until it comes to rest against a stop. In this case, the percussive mechanism is pushed in the upward return stroke direction, in the direction of the gas space, and assumes the impact position, wherein the gas pressure in the piston accumulator assumes a value higher than that in the rest position. When the percussive mechanism is activated, the percussive piston is then hydraulically moved further in the return stroke direction until it reaches its upper reversal point, at which the gas pressure assumes its highest value, wherein the position at the upper reversal point is dependent on the usage conditions of the percussive mechanism and the operating pressure and the pressure in the piston accumulator, and may therefore vary.

Owing to leakage along the seals and gas flows through the seal or the diaphragm or bubble diffusion, the gas pressure falls over the course of time. To maintain the effectiveness of the accumulator, it is thus necessary for the fill pressure in the accumulator to be checked at regular intervals and for the accumulator to be replenished with gas if required. For checking the gas pressure, fittings are necessary for the connection of a pressure measurement implement, for example a manometer, to the gas space. Such fittings comprise a hose and a manometer and, for filling and release purposes, also discharge and filling valves, a pressure reduction valve and screw connections in order for the fittings to be connected to a gas storage bottle. On the gas space, there is provided a shut-off valve or a mechanically opening check valve, to which the fittings are connected, and in addition, normally also a sealing closure screw for preventing an undesired escape of gas.

Since, during the operation of the percussive mechanism, the gas pressure in the piston accumulator constantly changes in a manner dependent on the position of the percussive piston, the gas pressure in the piston accumulator must be measured when the percussive piston is in a particular and defined position, which is possible only when the percussive mechanism is deactivated, that is to say when the hydraulic system is unpressurized. To measure the gas pressure, the rest position of the percussive piston is used, as the percussive piston is situated in a geometrically defined position, specifically at the lower stop.

The checking of the gas pressure is time-consuming because, before the measurement, components such as closure screws must be released, screw connections must be made and, after the measurement, the connection must be released again and the closure screw screwed in again.

Failure to carry out regular checks of the gas pressure can result in a drop in the gas pressure, which reduces the effectiveness of the accumulator and impairs the performance of the percussive mechanism and, for example as a result of excessively intense pressure fluctuations, can also lead to damage of components. The fittings and equipment for the checking of the gas pressure must be available for the checking of the gas pressure and must be operational, and the user must be familiar with the use of the fittings.

JP 2008114296 has disclosed a gas pressure indicator device which is arranged on the hydraulic chamber and in the case of which the gas pressure of the pressure accumulator acts directly on a spring-loaded piston which, with increasing gas pressure, is displaced in the direction of the spring. If the piston is displaced, a bar which is connected fixedly in terms of motion to the piston protrudes out of the housing of the indicator and reveals one or more marks, for example in the form of a groove. The higher the gas pressure acting on the piston, the further the piston is displaced, and the further the bar protrudes out of the housing. During the filling of the accumulator, the marking indicates a particular gas pressure. After measurement has been performed, by virtue of a cap being screwed onto the housing of the device, the bar and the piston are pushed in again counter to the pressure of the gas, in order that the piston and the bar do not permanently move owing to the fluctuating gas pressure during operation. To activate the indicator device, the cap must be removed again.

Percussive mechanisms may furthermore have pressure accumulators in the form of a hydraulic accumulator for the purpose of storing pressurized oil of the hydraulic system. The gas space of a hydraulic accumulator is separated from an oil space by way of a separating element in the form of a piston, an elastic diaphragm or an elastic, hose-like or pot-shaped bladder. The oil space is connected to the hydraulic system directly or via a throttle or a valve. In order to check the gas pressure or for filling purposes or in order to release the gas charge, corresponding fittings such as manometers, hoses and pressurized gas bottles can be connected by way of a valve which is connected to the accumulator space. If, in the hydraulic system, an operating pressure prevails which is higher than the fill pressure within the gas space, oil flows into the oil space and displaces the separating element in the direction of the gas space, whereby the oil space is increased in size, the gas space is reduced in size and the gas is compressed, to a pressure corresponding to the pressure of the oil. Thus, when the oil demand of the consumer is low, the oil that is delivered by the pump can be stored in the hydraulic accumulator in order to reduce the pressure increase in the hydraulic system, and when the demand of the consumer is high, oil can be released from said hydraulic accumulator in order to reduce the pressure drop in the hydraulic system. Intense pressure fluctuations and pressure peaks are thus avoided.

In the case of known indicator devices, it has proven to be disadvantageous that the indicator device must firstly be activated by a user by the removal of the cap, such that there is the risk that the user, in failing to adhere to the service intervals, neglects to perform such activation and the percussive mechanism is operated with an excessively low gas fill pressure, whereby the performance of the percussive mechanism is reduced and components are possibly damaged.

Even if the indicator device were always activated by virtue of the cap being left off, and wear of the indicator device were accepted, it would be the case even in the presence of an excessively low gas fill pressure that, during operation, the gas pressure would repeatedly exceed the required gas fill pressure, and the bar would repeatedly emerge from the housing such that the marking or markings would appear, which marking or markings would then at least intermittently indicate an adequate gas fill pressure. If this signal is interpreted incorrectly, an undershooting of the required gas fill pressure will not be noticed, and the percussive mechanism will consequently be operated with an excessively low gas fill pressure, resulting in a reduction in the performance of the percussive mechanism and the risk of damage to components.

SUMMARY OF THE INVENTION

It is an object of the invention to provide an indicator which does not need to be activated by manual handling, which exhibits a long service life and which indicates a signal only when the hydraulic chamber is in the operating state in which the percussive piston is situated in the rest position and a measurement of the gas fill pressure is possible.

The object is achieved by means of the device according to the invention, a second, hydraulics-side chamber and a hydraulics-side working surface, facing toward the indicator element, of the piston are connected to the hydraulic system of the percussive mechanism such that the indicator element, by way of its position, signals the undershooting of a critical pressure within the pressure accumulator if an exertion of pressure on the hydraulic working surface by the hydraulic system is interrupted, whereas a sliding movement of the piston and of the indicator element is blocked if the hydraulics-side working surface is acted on with the pressure of the hydraulic system.

By means of such a configuration, the gas pressure acts on a first (pressure accumulator-side) surface of a piston which is preferably fixed in terms of motion to a bar, wherein the gas force which thus acts causes a deployment movement of the bar. A second (hydraulics-side) surface of the piston, which is directed oppositely to the first surface, is thus connected to the hydraulics system such that, during the operation of the percussive mechanism, the high pressure from the feed line acts on the second surface. Since the surfaces are selected such that the force exerted on the piston by the oil pressure is significantly higher than the opposing force imparted by the gas pressure, the piston and the rod can move, and indicate the exceedance of a particular gas pressure, only when the percussive mechanism is deactivated and the percussive piston has assumed its rest position, wherein a measurement of the gas fill pressure is indeed meaningful only in said position.

The service life of the indicator components is increased in this way, because during operation of the percussive mechanism, the piston does not move continuously owing to the fluctuating gas pressure. Thus, it is also not necessary for the indicator to be mechanically blocked in order to increase the service life, such that an activation of the device by the user is not necessary.

A signal is triggered, in the event of an exceedance of the required gas fill pressure, by the appearance of the bar or of a marking applied to the bar only when the hydraulic chamber has been deactivated and the percussive piston has assumed, for example, its defined rest position which is required for the measurement of the gas pressure.

By virtue of the fact that, during operation, the indicator does not continuously indicate an exceedance of a gas pressure level but indicates the exceedance of a preset fill pressure only in a defined operating state, the rest position, said signal is observed and taken account of by the operator.

Preferred embodiments of the present invention will be disclosed below.

According to a first preferred embodiment of the present invention, the indicator element is a marked bar and the piston is mounted in slidingly movable fashion counter to the force of a spring which is preferably arranged within the hydraulics-side chamber of the housing and at least indirectly exerts on the piston a force which opposes the force generated by the pressure on the pressure accumulator-side working surface, such that the positioning of the bar is dependent on the pressure within the pressure accumulator if an exertion of pressure on the hydraulics-side working surface by the hydraulic system is interrupted, whereas a sliding movement of the indicator element is blocked if the hydraulics-side working surface is acted on with the pressure of the hydraulic system. In the case of such an embodiment, too, a movement of the piston and consequently of the indicator element occurs only when the hydraulic system is deactivated, resulting in only little wear of the indicator device. By means of the spring constant of the spring, it is furthermore possible to predefine a measure which allows the specific pressure prevailing in the pressure accumulator to be inferred, as the spring, which exerts on the piston a force acting in the same direction as the oil pressure, exerts a restoring force on the piston, and opposes the force generated by the gas pressure with an opposing force. By means of the spring, it is achieved that a deployment movement of the bar and the appearance of a marking occur only after a gas fill pressure dependent on the spring force is exceeded. By means of an adjustment mechanism, it is possible, through variation of the spring preload, to adjust the gas fill pressure at which the bar is deployed and a marking appears.

Since the length to which the bar protrudes beyond the housing is dependent on the gas pressure and increases with increasing gas pressure up to a maximum structurally limited length, the user must measure the length or take notice of whether one or more markings present on the plunger are visible. The reading of the indicator is thus more cumbersome and requires knowledge regarding the interpretation of the length or of the markings.

To make the reading easier, it is provided in a further preferred embodiment of the invention that the pressure accumulator is connected to the pressure accumulator-side chamber of the housing by way of two spring-loaded pressure valves, wherein the pressure valves are arranged in parallel and with opposite orientation. Here, the spring force of the spring of the pressure valve which provides a feed is advantageously configured such that the valve opens only when the critical pressure is overshot, and the indicator protrudes from the housing if an exertion of pressure on the hydraulic working surface by the hydraulic system is interrupted. An exertion of pressure on the hydraulics-side working surface effects a restoring movement and blocking of the piston, wherein the pressure within the pressure accumulator-side chamber is discharged via the pressure valve which provides a return. In this case, the pressure valve which provides a return and/or the pressure valve which provides a feed may be in the form of a spring-loaded check valve.

By means of these preferred embodiments, the gas pressure is conducted from the gas space of the pressure accumulator to the first piston surface of the gas pressure indicator not directly but only when a pressure valve produces a connection of the gas space to the piston surface after a preset pressure value has been exceeded, wherein the inlet of the pressure valve is connected to the gas space and the outlet is connected to the piston surface. The first piston surfaces and an optionally used spring which acts on the piston counter to the gas force are configured such that the gas pressure that must act on the piston in order for the bar to be deployed lies below the pressure at which the pressure valve produces a connection between the gas space and the first piston surface. Via a second pressure valve, which likewise connects the gas space to the first piston surface but which is arranged oppositely, such that the inlet of the second pressure valve is connected to the first piston surface and the outlet is connected to the gas space, gas can flow from the first piston surface back into the gas space when the piston and the bar are retracted. As pressure valves, use may for example be made of spring-preloaded check valves, pressure-limiting valves or pressure sequence valves.

A second piston surface, which is directed oppositely to the first, is thus connected to the hydraulics system such that, during the operation of the percussive mechanism, the high pressure from the feed line acts on the second surface. Since the surfaces are selected such that the force exerted on the piston by the oil pressure is significantly higher than the opposing force imparted by the gas pressure, the piston and the rod can move, and indicate the exceedance of a particular gas pressure, only when the percussive mechanism is deactivated and the percussive piston has assumed its rest position, wherein a measurement of the gas fill pressure is indeed meaningful only in said position.

The effectiveness of the indicator is increased, as the user must merely take notice of a clearly presented signal, and does not need to determine and interpret the distance to which the bar protrudes from the housing. If, when the chisel is situated horizontally or is not bearing against the material and the percussive mechanism is deactivated, the pressure in the gas space reaches the opening pressure set at the first pressure valve, gas is conducted to the first piston surface of the indicator. Since the second piston surface, which is connected to the feed line, is unpressurized, only the force of an optionally provided spring, and friction forces, oppose a displacement of the piston and of the bar. The pressure of the gas conducted via the valve from the gas space to the piston surface is sufficient to displace the piston and the bar by their maximum distance that is possible in structural terms, such that the bar is deployed by its maximum possible distance out of the housing and appears clearly to a user. The bar no longer assumes intermediate positions that are dependent on the gas pressure; rather, the bar is either fully deployed or fully retracted.

The bar can be deployed out of the housing only when the hydraulic hammer is not in operation, the feed line is not at operating pressure, and the percussive piston has assumed its rest position which is required for the measurement of the gas pressure, such that the indicator does not provide false signals during the operation of the percussive mechanism.

The piston of the indicator device can be implemented without a spring, as the restoring action is imparted by way of the oil pressure. Specifically in the case of percussive mechanisms which are subjected to high mechanical accelerations, damage to springs can occur. The pressure valves duly also have springs, but these are of much smaller design than the springs that would be required for the restoring action of the piston, and are thus less susceptible to damage.

Finally, in a further preferred embodiment of the invention, it is provided that the pressure accumulator is connected by way of a pressure sequence valve to the pressure accumulator-side chamber of the housing, wherein a parallel return line has a spring-loaded check valve.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
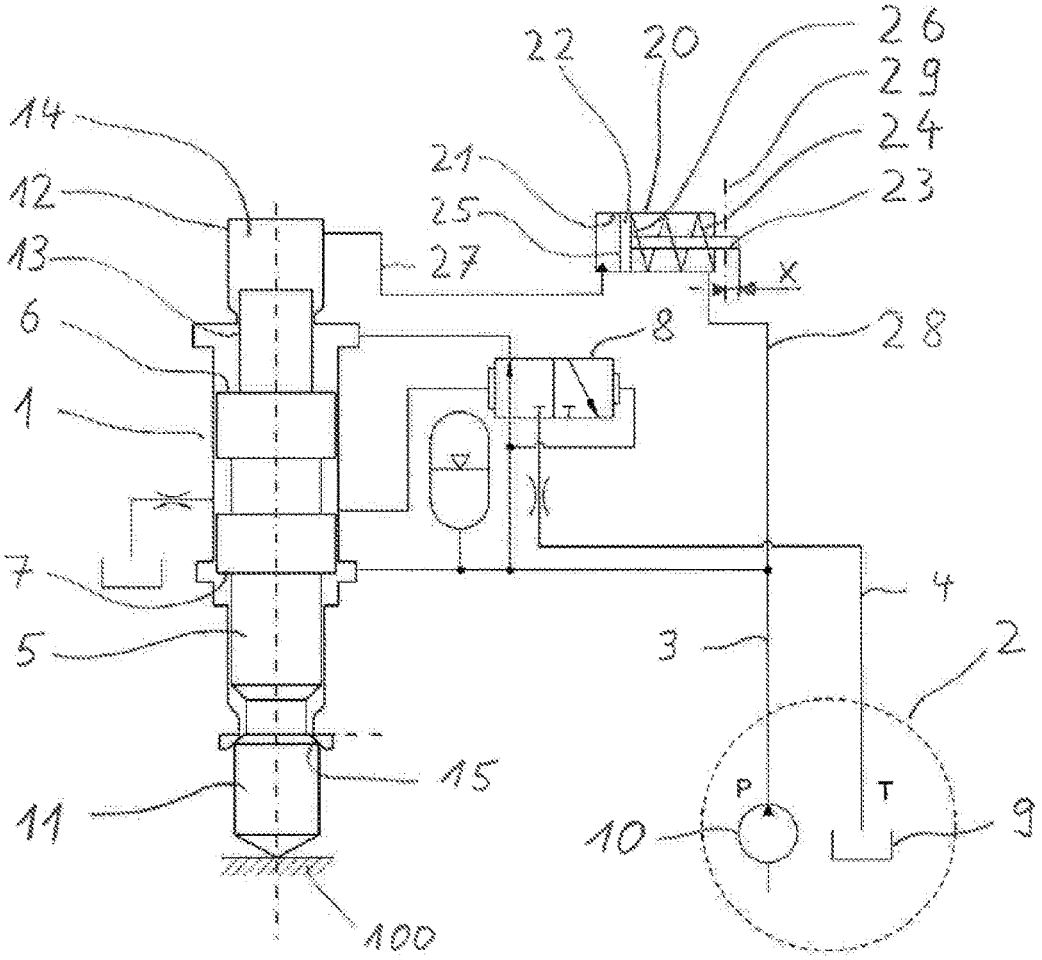
FIG. 1 is a schematic view of a hydraulic percussive mechanism according to a first embodiment.

Referring to the drawings, hydraulically operated percussive mechanisms 1 are used in mounted implements such as hydraulic hammers, drilling hammers etc., wherein the mounted implements are mounted on carrier vehicles, such as for example mobile excavators, and are connected to the hydraulic system 2 thereof via a pressure line 3 and a return line 4. On the carrier vehicle there is provided a switching valve which can break or establish the connection between the pump of the carrier vehicle and the pressure port of the percussive mechanism and between the tank of the carrier vehicle and the return port, in order to deactivate or activate the percussive mechanism.

Percussive mechanisms have a percussive piston 5 which has one or more hydraulic drive surfaces 6, 7, at least one of which can, by way of a valve 8 associated with the percussive mechanism, be connected alternately to a return line, which is at low pressure, to the tank 9 of the carrier vehicle or via a pressure line, which is at high pressure, to the pump 10 of the carrier vehicle, such that the percussive piston performs oscillating movements along its longitudinal axis. During normal operation, at the end of its movement in one movement direction, the percussive piston strikes a tool 11, wherein the tool is a chisel, a drill pipe, an adapter for piledriving or pipe driving, or an anvil arranged between the percussive piston and the tool.

Hydraulically operated percussive mechanisms have, in some cases, a pressure accumulator 12 in the form of a piston accumulator in order to store kinetic energy of the percussive piston. The upper, cylindrical end 13, situated opposite the tool, of the percussive piston projects into a gas-filled gas space 14 of the pressure accumulator, wherein a seal (not illustrated) which bears against the end of the piston prevents an escape of the gas along the percussive piston.

As the piston moves in the direction of the gas space during the return stroke, the end of the piston displaces gas within the gas space, which thus decreases in size, leading to an increase in the gas pressure. The gas exerts a force on the end of the piston, said force increasing as the gas volume decreases in size. Said force is utilized to accelerate the piston in a direction of movement toward the tool. During operation, there are thus three characteristic piston positions which can be associated with a respective gas pressure. For example, if a hydraulic hammer which has a percussive mechanism is raised or set down horizontally, its percussive piston is situated in the lowermost position, the rest position, in which the percussive piston bears against a piston stop 16 of the percussive mechanism housing and in which the gas pressure in the piston accumulator assumes its lowest value. Every time the processing of a piece of material using a hydraulic hammer is ended and the operation of the percussive mechanism is stopped, in order to position the chisel 11 on a different piece of material 100, the percussive piston assumes said rest position. If the chisel, as illustrated in FIG. 1, is pressed with its tip against material, the chisel is pushed into the housing of the percussive mechanism until it comes to rest against a stop 15. In this case, the percussive mechanism is likewise pushed in the upward return stroke direction, in the direction of the gas space, and assumes the impact position, and the gas pressure in the piston accumulator assumes a value higher than that in the rest position. When the percussive mechanism is activated, the percussive piston is then hydraulically moved further in the return stroke direction until it reaches its upper reversal point, at which the gas pressure assumes its highest value, wherein the position at the upper reversal point is dependent on the usage conditions of the percussive mechanism and the operating pressure and the gas fill pressure in the piston accumulator, and may vary slightly.

The percussive mechanism illustrated in FIG. 1 has a gas pressure indicator device 20, which is composed of a piston 22 guided in movable fashion in a housing equipped with a bore 21, of a bar 23 connected fixedly in terms of motion to the piston and of a spring 24. The piston divides the bore 21 into two chambers, in which in each case one piston surface 25, 26 is situated. A first piston surface 25 is connected by way of a line 27 to the gas space 14 of the pressure accumulator 12, such that the gas pressure prevailing in the gas space acts on the piston surface 25 and exerts on the piston a force which acts in the direction toward the housing surface 29. A second piston surface 26 is connected via a line 28 to the pressure line which connects the percussive mechanism to the pump 10 of the hydraulic system 2 of the carrier vehicle, such that during the operation of the percussive mechanism, the oil pressure prevailing in the pressure line acts on the second piston surface and exerts an oil force which opposes the gas force generated by the gas pressure. A spring 24 acts in the same direction as the oil force generated by the oil.

When the percussive mechanism is not in operation, and the pressure line and thus the second piston surface are not acted on with high oil pressure, the gas force generated by the gas pressure acting on the piston surface opposes the spring force. When the percussive piston 5 is situated in the position illustrated in FIG. 2*a*, in which it bears against the lower piston stop 16, the gas pressure assumes its lowest value. It is the intention for the gas fill pressure of the piston accumulator to be measured, and adjusted if necessary, in this structurally defined position. The surface area of the first surface and the spring are configured such that, when the gas fill pressure is correctly set, that is to say when the required gas fill pressure is reached or exceeded, the piston and thus the bar protrude by a predetermined distance X beyond the housing surface 29, which is illustrated as a dash-dotted line, of the pressure indicator and appears to the user. By varying the preload of the spring, the value of the pressure at which the piston is displaced to the right and the bar protrudes from the housing can be manipulated. The higher the gas pressure, the greater the extents to which the piston and bar are displaced to the right and the spring is shortened, whereby the spring generates an increasing opposing force. One or more markings (not illustrated in the figure) may be applied to the bar in order to indicate a particular gas pressure or gas pressure range.

If pressurized oil is supplied to the percussive mechanism for operation, said pressure, which is higher than the gas pressure, acts on the second piston surface and exerts on the piston an oil force which opposes the gas force and which displaces the piston and the bar to the left into their rest positions, until the bar has fully retracted into the housing.

The surface areas of the surfaces 25, 26 are configured such that, during the operation of the percussive mechanism, when the upper piston end of the percussive piston moves into the gas space and the gas pressure rises above the level of the gas fill pressure, the oil force continues to hold the piston in its rest position. As a result, the pressure indicator indicates the attainment or exceedance of a predefined gas fill pressure only when the percussive mechanism is deactivated and thus the percussive piston is moved into its rest position, in which the gas pressure can be clearly measured. Furthermore, the exertion of pressure on the second surface during the operation of the percussive mechanism has the effect that the piston and bar are not moved continuously by the fluctuating gas pressure, which is dependent on the percussive piston position. In this way, the noticeability of the signal of the indicator is increased, and wear is reduced.

Figure 2A:
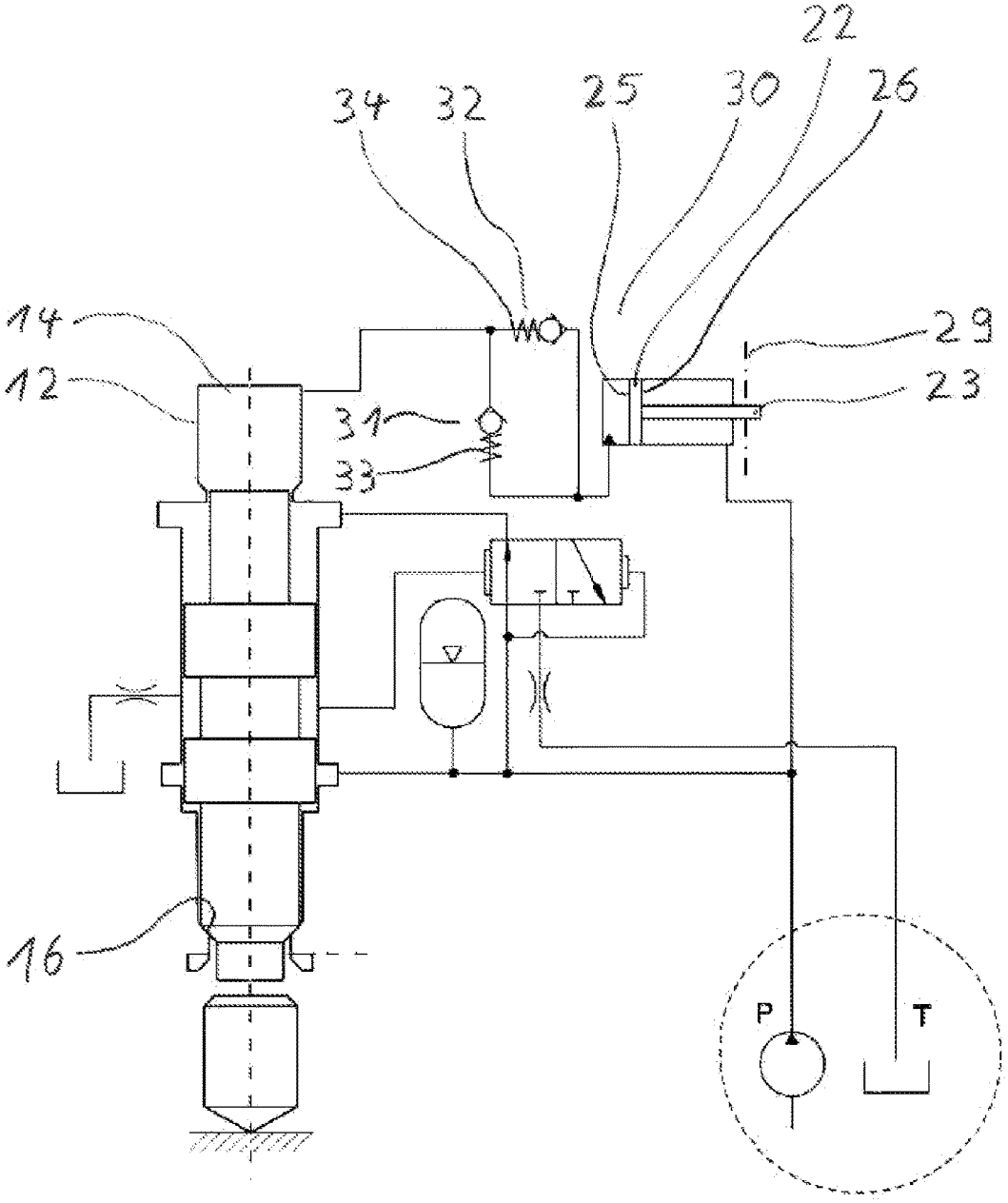
FIG. 2*a* is a schematic view of a hydraulic percussive mechanism according to a second embodiment.

The embodiment of the gas pressure indicator device 30 illustrated in FIG. 2*a* differs from that illustrated in FIG. 1 in that the space in which the first piston surface 25 is situated is connected to the gas space 14 of the pressure accumulator 12 not directly but via two check valves 31, 32. The check valves are arranged such that, via a first check valve 31, gas can flow from the pressure accumulator to the surface 25 but not in the opposite direction, and via a second check valve 32, gas can flow only from the surface 25 back to the gas space 14, but not in the opposite direction. The two check valves have a respective spring 33, 34, the spring force of which determines the pressure at which the valve opens and gas can flow via the valve. The spring 33 of the check valve 31 is configured such that the check valve opens only when the required gas fill pressure is reached or exceeded in the gas space, whereby it is then possible for the first time for the gas pressure to act on the surface 25 of the piston 22. In this case, if the pressure line and thus the space in which the piston surface 26 is situated are unpressurized, for example because the percussive mechanism has, in order to be positioned on a different piece of material, been deactivated and transferred, whereby the percussive piston has been displaced into its rest position which is required for the gas pressure measurement, a gas pressure in the range of the required gas pressure causes a displacement of the piston 22 and of the bar 23 fastened thereto. The gas pressure prevailing in the piston accumulator ensures that the percussive piston is displaced into its rest position when the percussive mechanism is deactivated and the pressure line is unpressurized. By contrast to the embodiment as per FIG. 1, there is no spring which acts on the piston so as to oppose the gas pressure, whereby the gas pressure acting on the surface 25 after the opening of the check valve 31 has the effect that the piston and bar are displaced to the right by their maximum distance that is possible in structural terms, and the bar protrudes beyond the housing surface 29 in a clearly apparent manner. The user does not need to check the extent to which the bar protrudes beyond the housing or whether a marking is visible, as the bar of the indicator device assumes only two clear indicator positions: the fully retracted position and the deployed position. By means of the preload of the spring 33, it is possible to preset the gas pressure value, the attainment or exceedance of which the indicator device is intended to indicate. If the percussive mechanism is activated and the oil pressure is conducted from the feed line to the piston surface 26, the force generated by the oil is much greater than the force generated by the gas, whereby a resultant restoring force acts on the piston, said restoring force returning the piston into the rest position in which the bar no longer protrudes beyond the housing surface 29. Since, through corresponding configuration of the spring 34, the opening pressure of the check valve 32 is low and lies considerably below the opening pressure of the check valve 31, the gas situated in the space in which the surface 25 is arranged is conveyed via the check valve 32 back into the gas space.

Figure 2B:
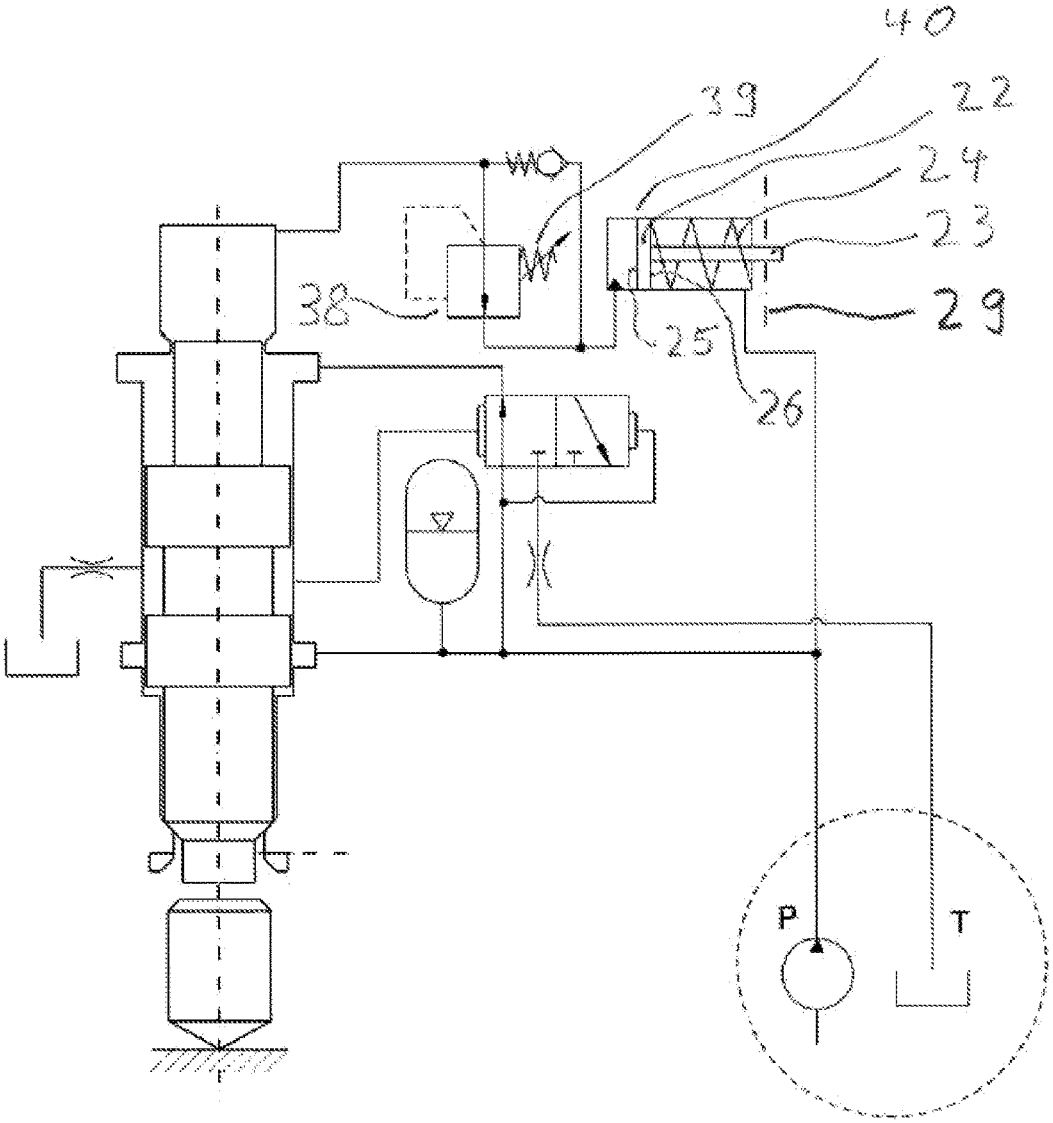
FIG. 2*b* is a schematic view of yet another embodiment of a hydraulic percussive mechanism according to a third embodiment.

The embodiment of the gas pressure indicator device 40 illustrated in FIG. 2*b* differs from that illustrated in FIG. 2*a* in that, instead of a check valve, a pressure valve in the form of a pressure sequence valve 38 is used which, when it opens, allows gas to flow from the gas space 14 to the piston surface 25. The illustration shows the valve in the open position, which the valve assumes when the gas pressure in the gas space has assumed a value higher than the opening pressure of the valve, wherein the opening pressure can be preset by way of the preload of a spring 39. Furthermore, the gas pressure indicator device differs from the embodiment as per FIG. 2*a* by a spring 24 which exerts only a low restoring force on the piston in relation to the gas force imparted by the surface 25 which is acted on by pressure. Said spring is not imperatively necessary but can serve for the compensation of flow losses or friction forces such as may arise at optional seals (not illustrated). Seals may be arranged between the bar 23 and the housing of the pressure indicator device and on the piston 22. Said seals serve to prevent gas from flowing from the surface 25 to the surface 26 or to prevent oil from escaping from the surface 26 to the housing surface 29 and thus passing into the atmosphere.

The gas pressure indicator device may be arranged directly on the housing of the percussive mechanism or on a component connected to the housing of the percussive mechanism, such as a valve block, or on the accommodating housing surrounding the percussive mechanism.

The gas space or those components of the gas pressure indicator device which are connected to the gas space of the accumulator may be equipped with valves and connection means in order for a manometer or other pressure indicator devices for determining the gas pressure to additionally be connected, or in order for the gas pressure to be reduced or released through a discharge of the gas or for the gas pressure to be increased through a supply of gas into the gas space. Said valves and connections are not illustrated in the exemplary embodiments but are known from known filling and testing devices for pressure accumulators of percussive mechanisms.

The bar may be equipped with several markings which denote different gas pressures.

Since, in the case of a constant volume, the gas pressure changes with changing gas temperature, the bar may have provided on it multiple markings which denote the attainment of the target gas pressure at different temperatures. In this way, it is possible for the gas pressure to be indicated even in the presence of gas temperatures which deviate from a predefined measurement temperature that is to be adhered to.

The position of the bar of the piston may be detected by way of electronics components for the purposes of triggering a signal, via an electrical signal transmission means, to other locations, for example to the carrier vehicle, or for the purposes of intervention into the hydraulic control of the percussive mechanism such that, in the event of undershooting of the target gas pressure, the hydraulic supply to the percussive mechanism is shut off or the operation of the percussive mechanism is stopped by intervention into the hydraulic control.

Contrary to the embodiments described above, in which, in the right-hand end position of the piston, the bar is fully retracted into the housing and is not visible to the user, the indicator may also be designed such that, in said end position, a part of the bar protrudes beyond the housing surface but said part is distinguished, by way of a marking, so as to clearly differ from that region of the bar which additionally appears when the piston and the bar are moved to the right in the direction of the other end position.

While specific embodiments of the invention have been shown and described in detail to illustrate the application of the principles of the invention, it will be understood that the invention may be embodied otherwise without departing from such principles.

What is claimed is:

1. A device for monitoring a pressure within a gas space of a pressure accumulator of a hydraulically driven percussive mechanism, the device having a housing in which at least a portion of a piston is mounted, together with an indicator element which extends through a face surface of the housing, the piston being slidingly movable, wherein the piston divides the housing into two chambers, and a first, pressure accumulator-side chamber and a pressure accumulator-side working surface of the piston are operatively connected at least indirectly to the gas space of the pressure accumulator, the pressure accumulator-side working surface being averted from the indicator element, the device comprising:

a second, hydraulics-side chamber and a hydraulics-side working surface, of the piston connected to a hydraulic system of the percussive mechanism such that the indicator element, by way of a position of the indicator element, signals an undershooting of a critical pressure within the pressure accumulator if an exertion of pressure on the hydraulics-side working surface by the hydraulic system is interrupted, the hydraulics-side working surface facing toward the indicator element, wherein a sliding movement of the piston and of the indicator element is blocked if the hydraulics-side working surface is acted on with a pressure of the hydraulic system.

2. A device according to claim 1, wherein the indicator element comprises a marked bar and the piston is mounted in slidingly movable fashion counter to a force of a spring and at least indirectly exerts on the piston a force which opposes the force generated by the pressure on the pressure accumulator-side working surface such that a positioning of the bar is dependent on the pressure within the pressure accumulator if an exertion of pressure on the hydraulics-side working surface by the hydraulic system is interrupted, wherein a sliding movement of the indicator element is blocked if the hydraulics-side working surface is acted on with the pressure of the hydraulic system.

3. A device according to claim 2, wherein said spring is arranged within the hydraulics-side chamber of the housing.

4. A device according to claim 2, wherein the pressure accumulator is connected to the pressure accumulator-side chamber of the housing via two spring-loaded pressure valves, wherein the two spring-loaded pressure valves are arranged in parallel and with opposite orientation.

5. A device according to claim 1, wherein the pressure accumulator is connected to the pressure accumulator-side chamber of the housing via two spring-loaded pressure valves, wherein the two spring-loaded pressure valves are arranged in parallel and with opposite orientation.

6. A device according to claim 5, wherein a spring force of a spring of one of said two spring-loaded pressure valves is configured such that the one of said two spring-loaded pressure valves opens only when a critical pressure is overshot, and the indicator element emerges from the housing if an exertion of pressure on the hydraulics-side working surface by the hydraulic system is interrupted, said one of said two spring-loaded pressure valves providing a feed.

7. A device according to claim 6, wherein at least said one of said two spring-loaded pressure valves is in a form of a spring-loaded pressure sequence valve, said at least said one of said two spring-loaded pressure providing a feed.

8. A device according to claim 7, wherein the gas space of the pressure accumulator is connected via a pressure sequence valve to the pressure accumulator-side chamber of the housing, wherein a parallel return line has a spring-loaded check valve which is arranged such that gas can flow back from the pressure accumulator-side chamber into the gas space.

9. A device according to claim 5, wherein an exertion of pressure on the hydraulics-side working surface provides a restoring movement and blocking of the piston, wherein the gas within the pressure accumulator-side chamber is conducted back into the gas space of the pressure accumulator via one of said two spring-loaded pressure valves, which provides a return.

10. A device according to claim 9, wherein at least said one of said two spring-loaded pressure valves is in a form of a spring-loaded check valve, said at least said one of said two spring-load pressure valve providing the return.

11. A device according to claim 1, wherein said percussive mechanism is one of a demolition hammer and a drilling hammer.

12. A device according to claim 1, wherein the gas space is at least filled with a gas, the gas comprising nitrogen.

13. A device for monitoring pressure within a gas space of a pressure accumulator of a hydraulically driven percussive mechanism, the device comprising:

a housing;

an indicator element;

a piston, at least a portion of said piston and at least a portion of said indicator element being mounted in said housing, wherein at least another portion of said indicator element extends through a face surface of said housing such that said indicator element is movable relative to said housing, said piston comprising a pressure accumulator-side working surface and a hydraulics-side working surface, said pressure accumulator-side working surface facing in a direction away from said indicator element, said hydraulic-side working surface facing in a direction of said indicator element, said piston defining at least a portion of two chambers in said housing, said two chambers comprising a pressure accumulator-side chamber and a hydraulics-side chamber, said pressure accumulator-side working surface and said pressure accumulator-side chamber being operatively connected at least indirectly to the gas space of the pressure accumulator, said hydraulics-side chamber and said hydraulics-side working surface being connected to a hydraulic system of the percussive mechanism such that a position of the indicator element signals an undershooting of a critical pressure within the pressure accumulator if an exertion of pressure on the hydraulic-side working surface by the hydraulic system is interrupted, wherein movement of the piston and the indicator element is blocked if the hydraulics-side working surface is acted on with a pressure of the hydraulic system.

14. A device according to claim 13, wherein the indicator element comprises a marked bar and the piston is mounted in slidingly movable fashion counter to a force of a spring and at least indirectly exerts on the piston a force which opposes the force generated by the pressure on the pressure accumulator-side working surface such that a positioning of the bar is dependent on the pressure within the pressure accumulator if an exertion of pressure on the hydraulics-side working surface by the hydraulic system is interrupted, wherein a sliding movement of the indicator element is blocked if the hydraulics-side working surface is acted on with the pressure of the hydraulic system.

15. A device according to claim 13, wherein the pressure accumulator is connected to the pressure accumulator-side chamber of the housing via two spring-loaded pressure valves, wherein the two spring-loaded pressure valves are arranged in parallel and with opposite orientation.

16. A device according to claim 15, wherein a spring force of a spring of one of said two spring-loaded pressure valves is configured such that the one of said two spring-loaded pressure valves opens only when a critical pressure is overshot, and the indicator element emerges from the housing if an exertion of pressure on the hydraulics-side working surface by the hydraulic system is interrupted, said one of said spring-loaded pressure valves providing a feed.

17. A device according to claim 16, wherein at least said one of said two spring-loaded pressure valves is in a form of a spring-loaded pressure sequence valve, said at least said one of said two spring-loaded pressure valves providing a feed.

18. A device according to claim 17, wherein the gas space of the pressure accumulator is connected via a pressure sequence valve to the pressure accumulator-side chamber of the housing, wherein a parallel return line has a spring-loaded check valve which is arranged such that gas can flow back from the pressure accumulator-side chamber into the gas space, said percussive mechanism being one of a demolition hammer and a drilling hammer.

19. A device according to claim 15, wherein an exertion of pressure on the hydraulics-side working surface provides a restoring movement and blocking of the piston, wherein the gas within the pressure accumulator-side chamber is conducted back into the gas space of the pressure accumulator via one of said two spring-loaded pressure valves, which provides a return.

20. A device according to claim 19, wherein at least said one of said two spring-loaded pressure valves is in a form of a spring-loaded check valve, said at least said one of said two spring-loaded pressure valves providing the return.

21. A device according to claim 13, wherein the gas space is at least filled with a gas, the gas comprising nitrogen.

22. A device for monitoring pressure, comprising:

a hydraulically driven percussive mechanism comprising a pressure accumulator and a hydraulic system, said pressure accumulator comprising a fluid space, which is filled with fluid and/or is prestressed;

a housing;

an indicator element;

a piston, at least a portion of said piston and at least a portion of said indicator element being mounted in said housing, wherein at least another portion of said indicator element extends through a face surface of said housing such that said indicator element is movable relative to said housing, said piston comprising a pressure accumulator-side working surface and a hydraulics-side working surface, said pressure accumulator-side working surface facing in a direction away from said indicator element, said hydraulic-side working surface facing in a direction of said indicator element, said piston dividing an interior space of said housing into two chambers, said two chambers comprising a pressure accumulator-side chamber and a hydraulics-side chamber, said pressure accumulator-side working surface and said pressure accumulator-side chamber being operatively connected at least indirectly to the fluid space of the pressure accumulator, said hydraulics-side chamber and said hydraulics-side working surface being connected to said hydraulic system of the percussive mechanism such that a position of the indicator element signals an undershooting of a critical pressure within the pressure accumulator if an exertion of pressure on the hydraulic-side working surface by the hydraulic system is interrupted, wherein movement of the piston and the indicator element is blocked if the hydraulics-side working surface is acted on with a pressure of the hydraulic system.

* * * * *